US005513745A

United States Patent [19]

Zoltan et al.

[11] Patent Number: 5,513,745

[45] Date of Patent: May 7, 1996

[54] SHIPMENT AND DISPLAY FIXTURE FOR GREETING CARDS

[75] Inventors: Frank Zoltan, Cincinnati; John Broerman, Maineville, both of Ohio

[73] Assignees: Gibson Greetings, Inc., Cincinnati, Ohio; Jefferson-Smurfit Corp., St. Louis, Mo.

[21] Appl. No.: 329,196

[22] Filed: Oct. 26, 1994

[51] Int. Cl.[6] ..... B65D 5/50

[52] U.S. Cl. ..... 206/741; 206/449; 206/764; 211/55; 211/132; 248/174

[58] Field of Search ..... 40/124, 124.2; 211/55, 50, 132; 206/45, 45.11, 45.13, 45.19, 449; 248/174

[56] References Cited

U.S. PATENT DOCUMENTS

| | | | |
|---|---|---|---|
| D. 219,957 | 2/1971 | Spahr . | |
| 342,316 | 5/1886 | Bickford . | |
| D. 346,742 | 5/1994 | Gannon et al. . | |
| 483,751 | 10/1892 | Smith . | |
| 918,186 | 4/1909 | Morse . | |
| 1,008,722 | 11/1911 | Kunz . | |
| 1,062,020 | 5/1913 | MacOrquodale . | |
| 1,573,149 | 2/1926 | Engel | 206/45 |
| 1,991,030 | 2/1935 | Schimmel . | |
| 2,261,605 | 11/1941 | Smith . | |
| 2,914,184 | 11/1959 | Dgetluck | 206/45 |
| 3,999,662 | 12/1976 | Barnhardt | 206/45 X |
| 4,011,943 | 3/1977 | Galli et al. . | |
| 4,041,631 | 8/1977 | Stevens . | |
| 4,053,101 | 10/1977 | Hart, Jr. . | |
| 4,069,941 | 1/1978 | Popplewell, Jr. et al. . | |
| 4,077,520 | 3/1978 | Stevenson . | |
| 4,225,039 | 9/1980 | Skaggs . | |
| 4,267,959 | 5/1981 | Gilbert . | |
| 4,444,314 | 4/1984 | Jacobsson . | |
| 4,475,659 | 10/1984 | Wells et al. . | |
| 4,621,878 | 11/1986 | Johnson et al. . | |
| 4,736,837 | 4/1988 | Brainard . | |
| 4,753,341 | 6/1988 | McIntyre | 206/45 |
| 4,783,918 | 11/1988 | Valery . | |
| 4,832,189 | 5/1989 | Stevens . | |
| 4,875,590 | 10/1989 | Martin et al. . | |
| 4,905,824 | 3/1990 | Stevens . | |
| 4,938,366 | 7/1990 | Carroll . | |
| 4,949,849 | 8/1990 | Hardy . | |
| 4,982,839 | 1/1991 | Stevens . | |
| 5,009,335 | 4/1991 | Jonker . | |
| 5,040,688 | 8/1991 | Martin et al. . | |
| 5,074,411 | 12/1991 | Stevens . | |
| 5,148,942 | 9/1992 | Snook . | |
| 5,289,926 | 3/1994 | Lewis et al. . | |

*Primary Examiner*—Bryon P. Gehman
*Attorney, Agent, or Firm*—Wood, Herron & Evans

[57] ABSTRACT

A shipping and display fixture suitable for greeting cards and other similar flat merchandise, which not only holds the greeting cards during shipment, but can be readily converted from a shipping container to a visually pleasing and functional display fixture for displaying the greeting cards at a retail site.

33 Claims, 5 Drawing Sheets

SHIPMENT AND DISPLAY FIXTURE FOR GREETING CARDS

FIELD OF THE INVENTION

The present invention relates to shipment and display containers for greeting cards and other flat objects.

BACKGROUND OF THE INVENTION

Greeting cards are typically displayed for retail in permanent fixtures installed at the retail site. These fixtures hold greeting cards in specially designed pocketed shelves, such that the greeting card is held at an angle relative to the vertical and the upper front surface of the card is exposed for optimum browsing and selection by the consumer.

Many greeting cards are holiday-specific, that is, the cards refer to a particular holiday and can only be sold in the period leading up to that holiday. Furthermore, the demand for greeting cards varies widely from holiday to holiday. Thus, retailers are constantly readjusting their stock of greeting cards, removing cards relating to one holiday and replacing these with cards relating to another holiday. In addition, retailers will typically have some periods when insufficient retail space is devoted to greeting cards, and also some periods when too much retail space is devoted to greeting cards.

One known solution to these difficulties is to use temporary shelving to display greeting cards. For example, some retailers purchase temporary display fixtures manufactured of disposable materials such as cardboard, and set up these displays to display holiday-specific greeting cards (for example, Christmas cards for identified family members) during seasonal peak demand periods. Thus, retail space is used in a more optimal way and the need to readjust the stock in the permanent shelving is reduced.

Known temporary display fixtures suffer from a number of disadvantages. Some fixtures essentially comprise a box fitted with dividers to form compartments for holding greeting cards. This structure is relatively simple to assemble, but has the drawback that the displayed greeting cards are recessed within the compartments of the box and are not easily read or prominently displayed as compared to a permanent greeting card display. Furthermore, the temporary display more closely resembles a box than a permanent greeting card display, and is not visually pleasing to the consumer.

There are more elaborate fixtures which support the greeting cards in a position more similar to that achieved by a permanent display. However, such fixtures typically have a complex structure and must be assembled by the retailer from flat blanks, resulting in complex and inefficient display setup.

Thus, there remains a need for a temporary greeting card display which displays cards in an effective, visually pleasing manner, but is also simple for the retailer to assemble.

SUMMARY OF THE INVENTION

In one aspect, the invention features a shipment and display fixture for greeting cards or other flat merchandise which can be assembled at the manufacturer and used as a shipping container for greeting cards, but can also be easily erected by a retailer to form an attractive display fixture. The fixture includes a tray and one or more dividers mounted to two nonadjacent walls of the tray. Slots cut in the dividers mate with slots cut in one or more shelves to support the shelves in the tray. Each shelf includes a front panel which is inserted into the dividers, and rear flaps folded at an angle to the front panel. The rear flaps extending from the front panel on either side of the dividers between the front panel and the back of the tray. The fold between the front panel and the rear flaps forms a pocket in which the greeting cards or other flat merchandise can be inserted for shipment and display.

In one embodiment the fixture includes a single such tray, and in another embodiment the fixture includes two such trays joined together by a hinge fold between their side walls. The two trays are folded together to form an enclosed container for protecting the cards during shipment, and are unfolded by the retailer to form the display.

In either embodiment, the shelves may include a third panel folded over the front panel. This third panel bears decorative printing which can be seasonably related to the greeting cards in the shelves.

During display, the fixture may be supported by a four-sided base. Two opposing walls of the base include notches for receiving and supporting the tray(s). Furthermore, a crown panel, bearing decorative printing which can be seasonably related to the greeting cards in the shelves, is attached to the top side wall of the fixture.

The entire fixture may be manufactured of paperboard, or any other light weight and disposable or recyclable material.

The above and other features, objects and advantages of the present invention shall be made apparent from the accompanying drawings and the description thereof.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1A:
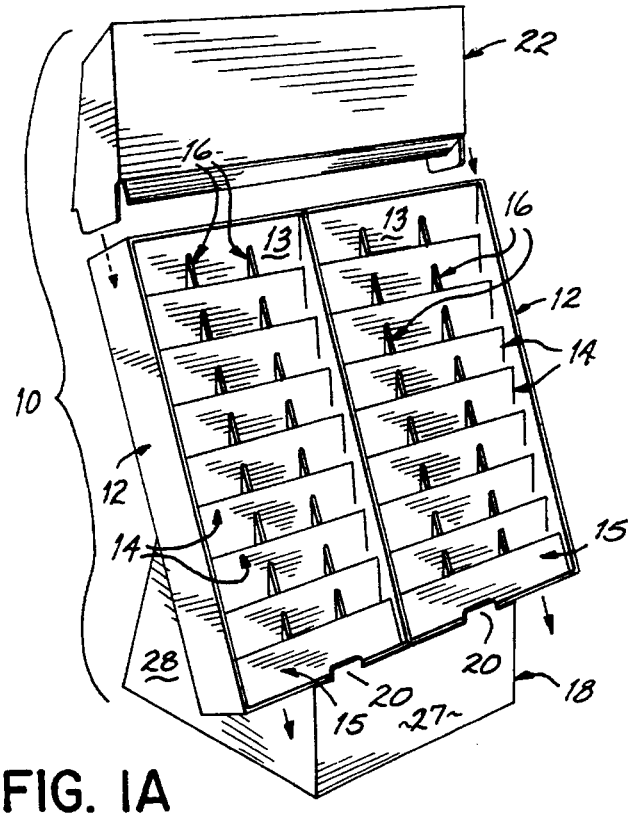
FIG. 1A is a perspective view of an erected shipment and display fixture for greeting cards in accordance with principles of the present invention.

Referring to FIG. 1A, a card shipment and display fixture 10 in accordance with the principles of the present invention comprises two trays 12, each of which supports shelves 13, 14 and 15 upon vertical dividers 16. Shelves 13, 14 and 15 are supported at an angle relative to the planar rear surface of tray 12 and are configured to support a number of greeting cards or similar items of flat merchandise in a vertical upright position suitable for review by a consumer.

Trays 12 are used as a display for greeting cards, and is supported by a base 18. Base 18 includes two tabs 20 which interlock with the bottom of trays 12 to retain trays 12 into notches in side walls of base 18. When erected for display, fixture 10 also includes a decorative crown 22, which is inserted into folds in trays 12 and is supported above the top of trays 12.

Trays 12, base 18, and crown 22 may be fabricated of any resilient and disposable or recyclable material, such as 3-ply, 200 pound, B-flute corrugated board (kraft paper) with color-coated liners including lithographed decoration, as noted below.

Figure 1B:
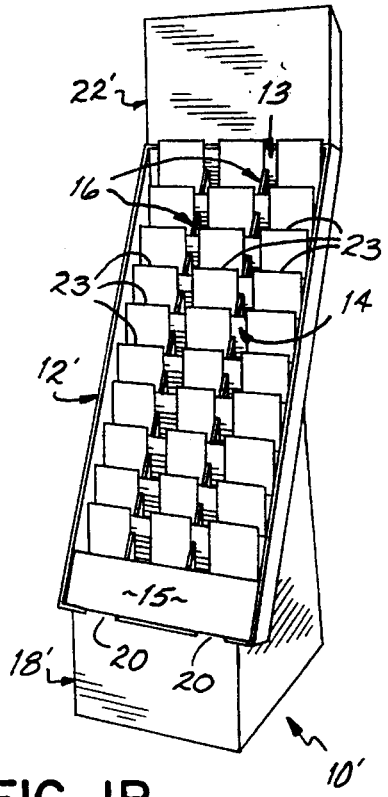
FIG. 1B is a perspective view of an alternative embodiment of an erected shipment and display fixture for greeting cards in accordance with principles of the present invention.

Referring to FIG. 1B, in an alternative embodiment of the invention, fixture 10' comprises a single tray 12' including dividers 16 and shelves 13, 14 and 15 similar to those in trays 12 discussed above with respect to FIG. 1A. This alternative, single-tray embodiment of fixture 10' is also supported by a suitably sized base 18'. When erected for display, this embodiment of fixture 10' also includes a suitably sized decorative crown 22' inserted into folds of tray 12' and supported above tray 12'.

FIG. 1B also illustrates greeting cards 23 inserted into shelves of fixture 10'. Greeting cards 23 extend generally vertically from each shelf and in such a manner as to permit easy scanning of the upper face of the greeting card by a consumer.

Figure 2A:
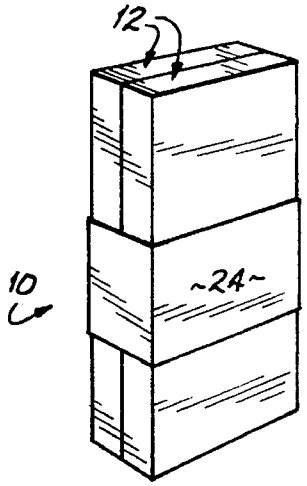
FIG. 2A is a perspective view of the fixture of FIG. 1A in the form in which it is received by a retailer.

Referring to FIG. 2A, fixture 10 of FIG. 1A is received at a retailer in a partially assembled form. In this partially assembled form, trays 12 are folded together to form a single rectangular box containing greeting cards 23 or other items to be sold using fixture 10. Trays 12 are preferably held in this closed folded position by a band 24. Base 18 and crown 22, shown in FIG. 1A, may be collapsed to a flat form and inserted between trays 12, and are in this form when fixture 10 is received by a retailer. The entire assembly is held inside of a shipping carton (not shown).

Figure 2B:
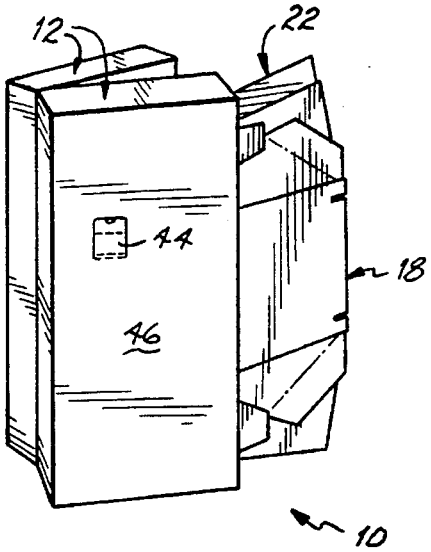
FIG. 2B is a partially disassembled view of the fixture of FIG. 1A showing removal of the base 18 and crown 22.

Referring to FIG. 2B, to assemble fixture 10, a retailer, having received fixture 10 in the form shown in FIG. 2A, first removes band 24 to release trays 12 from their folded position. Then, trays 12 are unfolded as shown, permitting base 18 and crown 22 to be removed from between trays 12.

Figure 2C:
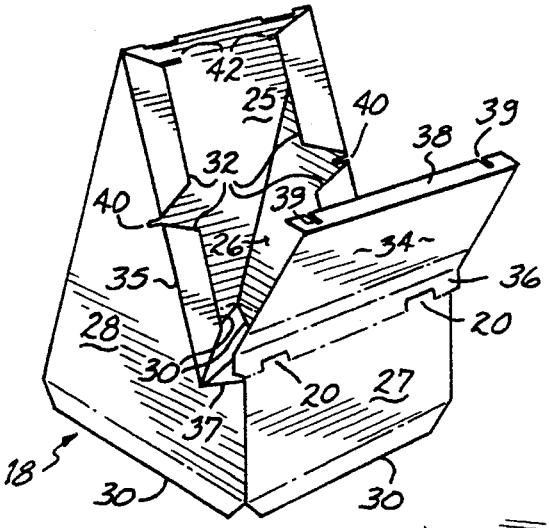
FIG. 2C is a perspective view showing assembly of the base 18.

Referring to FIG. 2C, base 18, when received from a retailer, is in the form of a single corrugated board blank having four panels 25, 26, 27, and 28, where panels 25 and 26 are glued along their edges. When erected as shown in FIG. 2C, panels 25, 26, 27 and 28 form four vertical walls of base 18.

Flaps 30 which surround the lower edges of panels 25, 26, 27 and 28 are folded inward toward the inside of base 18 to provide stiffness to the lower edges of panels 25, 26, 27 and 28 when base 18 is supporting the remainder of fixture 10. Similarly, flaps 32 along the upper edge of panels 28 and 26 are folded inward toward the center of base 18 to provide support for the upper edges of panels 26 and 28 when base 18 is supporting the remainder of fixture 10.

To complete the assembly of base 18, a portion of panel 27, including sections 34, 36 and 38, is folded to form a shelf suitable for holding trays 12 of fixture 10 as shown in FIG. 1A. First section 36 is folded away from the plane of the lowermost portion of panel 27 and towards the interior of base 18. Section 36 forms a shelf supported along upper notch edge 37 of panel 28 and a similar edge (not shown) on panel 26. Section 34 of panel 27 is folded at an approximate right angle to section 36 and lays along edge 35 of panel 28 and a similar edge (not shown) of panel 26 to provide a rear support for trays 12 when trays 12 are assembled to base 18 as shown in FIG. 1A. Finally, section 38 is folded at an approximate right angle to section 34 such that slots 39 engage to slots 40 in panels 26 and 28 between flaps 32. This engagement between slots 39 and slots 40 retains sections 34 and 36 in their proper positions along edges 35 and 37 as trays 12 are inserted onto base 18.

Figure 2D:
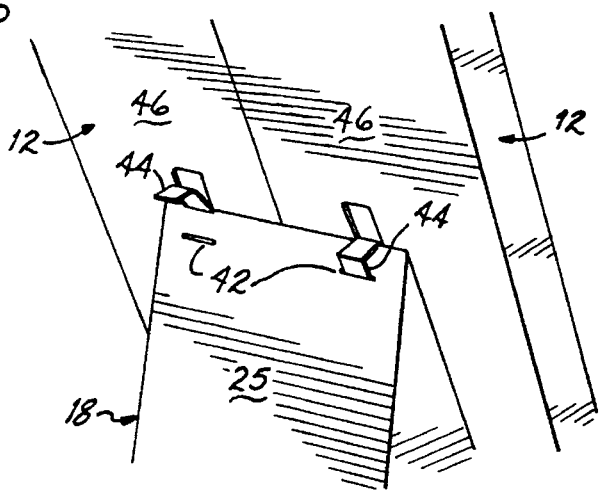
FIG. 2D is a partial perspective view showing assembly of trays 12 to base 18.

Referring to FIGS. 2B, 2C and 2D, rear panel 25 of base 18 includes slots 42 (see FIGS. 2C and 2D). Trays 12 include tabs 44 which are perforated from the rear surface of trays 12 and can be folded outward as shown in FIG. 2D. When trays 12 are placed onto base 18 as shown in FIGS. 2A and 2D, tabs 44 may be folded outward from the rear surfaces of trays 12 and inserted into slots 42 to retain trays 12 to base 18.

After assembling base 18 and placing trays 12 onto base 18 as noted above, the retailer completes the assembly of fixture 10 by inserting crown 22 into the folds of trays 12 (see FIG. 1A), producing the finished display fixture.

Greeting cards are shipped with fixture 10 already inserted into the shelves of the fixture. For protection, the cards may be encased in a plastic wrapping, which may be readily removed from the cards by the retailer. Greeting cards 23 in the top row of the fixture may extend outside the perimeter of tray 12, as can be seen in FIG. 1B; if this is the case, before shipment the cards to be placed in the top row of the fixture may be inserted in another row.

Because the display fixture also serves as a shipping container for shipping the greeting cards, the shipping container and cards may be seasonally matched; for example, crown 22 may contain a lithographed holiday message matched to the holiday-specific cards shipped in the fixture. Trays 12 and shelves 13, 14 and 15 may also contain holiday-specific decoration, or may simply be colored with appropriate holiday colors, such as pink during the Easter season and green during the Christmas season.

Figure 3A:
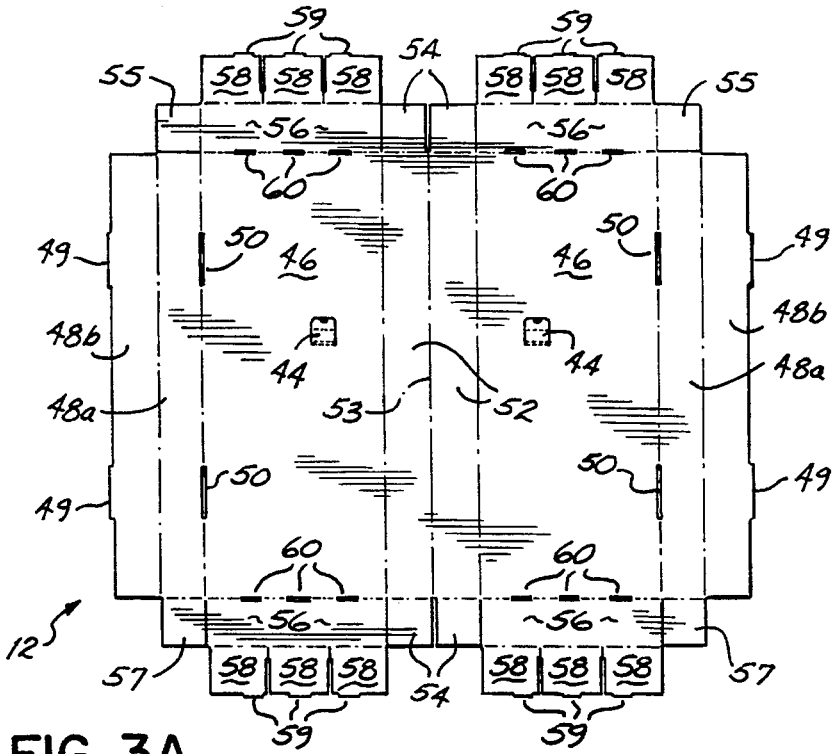
FIG. 3A is a plan view of the corrugated board blank which forms trays 12 of the fixture of FIG. 1A, FIGS. 3B, 3C and 3D are plan views of the corrugated board blanks which forms bottom shelf, middle and top shelves, respectively.

Referring to FIG. 3A, the blank which forms trays 12 includes two panels 46 which form the backs of trays 12 when assembled. Back sections 46 contain tabs 44, discussed above with reference to FIGS. 2B and 2D. The exterior walls of trays 12 are formed from panels **48*a* and 48*b*. Each panel 48*a* is folded at an approximate right angle to panel 46, and then each panel 48*b* is doubled over panel 48*a* to form a double sidewall of tray 12. Tabs 49 on panel 48*b* mate with slots 50 between panels 46 and 48*a*** to retain the sidewall in place.

Interior sidewalls of trays 12 are formed from panels 52. Panels 52 share a common fold line 53 which also joins one tray 12 to the other tray 12. Trays 12 hinge from a closed position shown in FIG. 2A to an open position shown in FIGS. 2B and 1A by bending along fold line 53.

Top and bottom walls of tray 12 are formed by panels 56 and 58. Panels 56 and 58 cooperate with flaps 54, 55 and 57 to provide support for the corners of trays 12. To do so, flaps 54 and 57, which are respectively connected by fold lines to panels 52 and **48*a*, are folded at an approximate right angle to panels 52 and 48***a*, such that flaps 54 and 57 project from panels 52 and 48*a* and form a corner with these panels and panel 46. Next, flaps 55, which are connected by fold lines to panels 56, are folded at an approximate right angle to panels 56. Then, panel 56 is folded at an approximate right angle to panel 46, into contact with flaps 54 and 57 projecting from panels 52 and 48*a*. During this operation, flaps 55 are inserted between panels 48*a* and 48*b*. Next, flaps 58 are folded over panel 56, the outer flaps 58 enclosing and retaining flaps 54 and 57. Tabs 59 in flaps 58 mate with slots 60 between panels 56 and 46 to hold flaps 58 in place. (Flaps 58 are also retain vertical dividers 16 in place. This interaction is discussed in further detail below with reference to FIG. 4.)

Figure 3B:
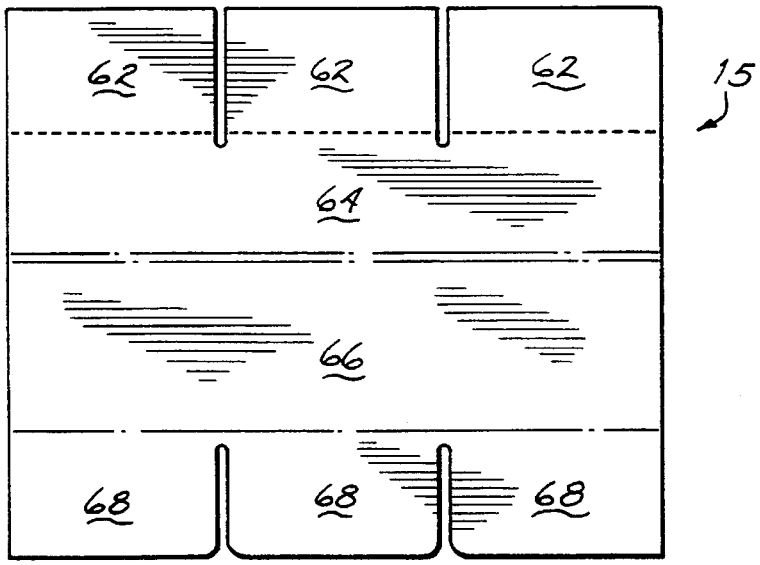
FIG. 3E is a plan view of a corrugated board blank which forms a divider.

Referring to FIG. 3B, a blank for a bottom shelf 15 includes three flaps 62 which project from a panel 64, which is coupled by a fold line to a panel 66, which is coupled to a fold line to three flaps 68. The interaction of these panels and flaps to create a bottom shelf is discussed in further detail below with reference to FIG. 5A.

Figure 3C:
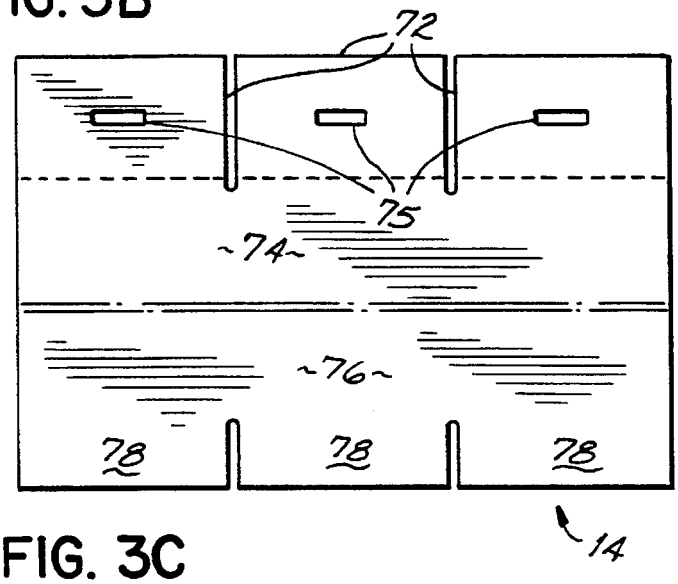

Referring to FIG. 3C, a middle shelf blank 14 includes three flaps 72, each including a hole 75. The flaps 72 are each joined by a fold line to a panel 74. Panel 74 is joined by second and third fold lines to a panel 76, and three flaps 78 project from panel 76. The manner in which middle shelf blank 14 is folded and inserted into trays 12 to form a middle shelf is discussed in further detail below with reference to FIG. 5B.

Figure 3D:
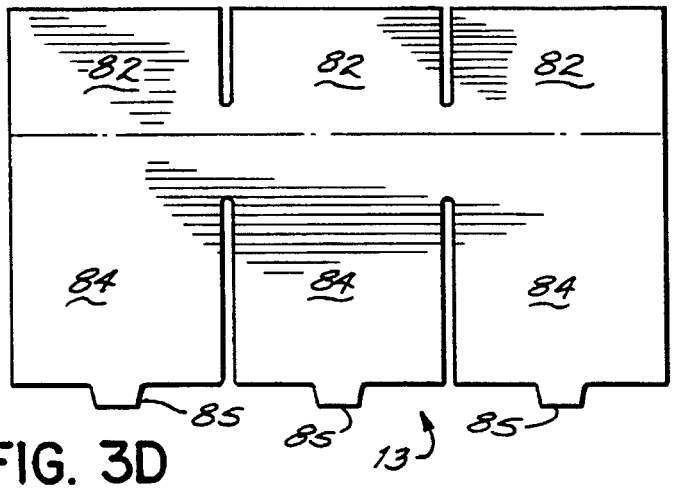

Referring to FIG. 3D, a top shelf blank 13 includes three flaps 82 joined by a fold line to three flaps 84. Three tabs 85 extend from flaps 84. The manner in which upper shelf 13 is arranged and inserted into tray 12 to form an upper shelf is discussed in further detail below with reference to FIG. 5C.

Figure 3E:
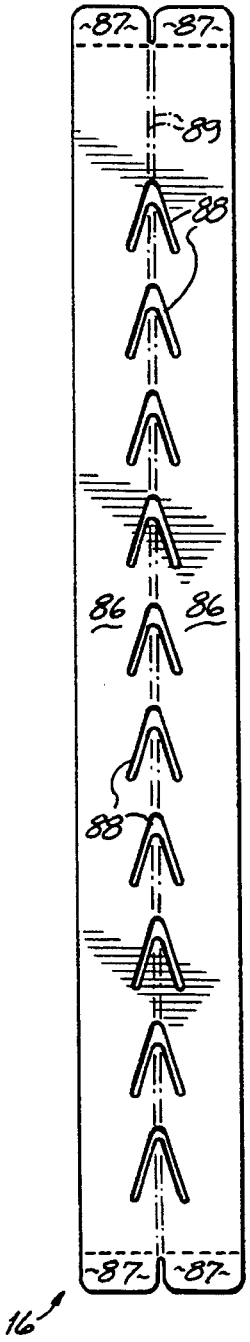

Referring to FIG. 3E, a blank for a vertical divider 16 includes two elongated panels 86 joined by fold lines 89. Each panel 86 has extending flaps 87 which are used in the manner described with reference to FIG. 4 below to retain divider 16 inside of tray 12. Panels 86 also include V-shaped holes 88 which extend over fold line 89. Panels 86 are folded together along fold line 89 into a vertical divider 16. This causes V-shaped holes 88 to form angled slots in the divider 16, which are used to support shelves as discussed in further detail below with reference to FIGS. 5A–5C.

Figure 4:
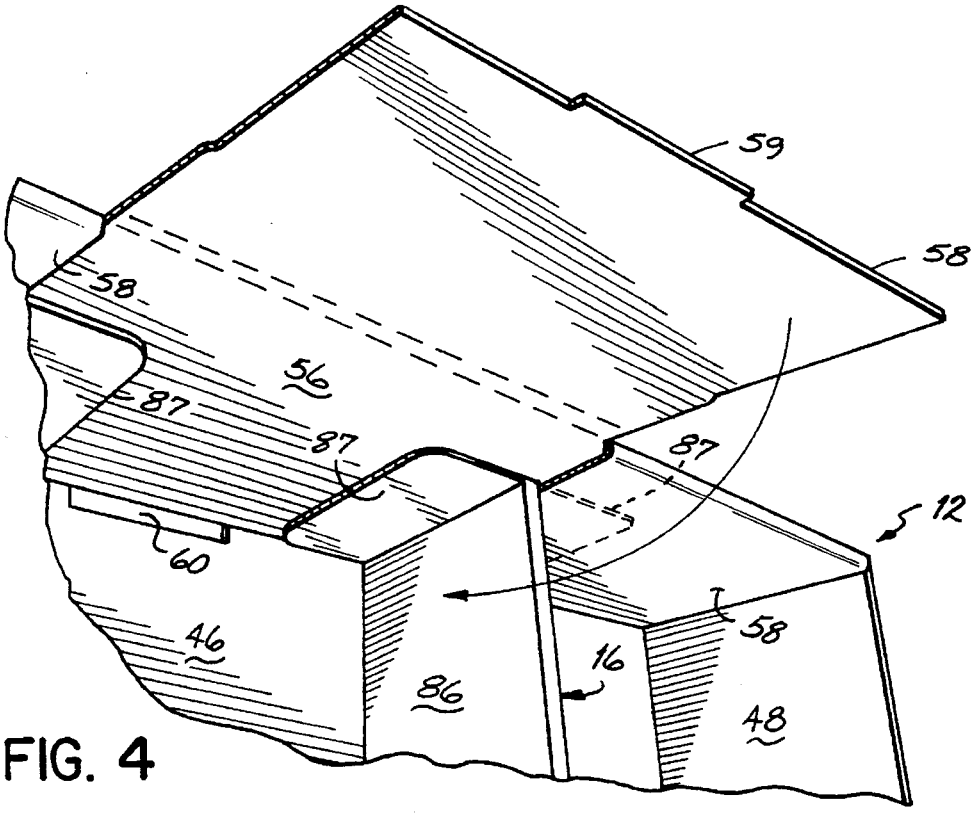
FIG. 4 is a partial perspective view showing assembly of a divider into a tray.

Referring to FIG. 4, a vertical divider 16, which comprises two flaps 86 folded together over fold lines 89 (see FIG. 3E), is inserted into and retained into tray 12 by interaction between flaps 87 of divider 16, and panels 56 and flaps 58 of trays 12. Flaps 87 are folded at an approximate right angle to flaps 86 in an outwardly fanning direction. Then, divider 16 is inserted into tray 12. Next, flaps 58 are folded over flaps 87 to retain to flaps 87 between panel 56 flaps 58. Thus, divider 16 is held in position into tray 12.

Figure 5A:
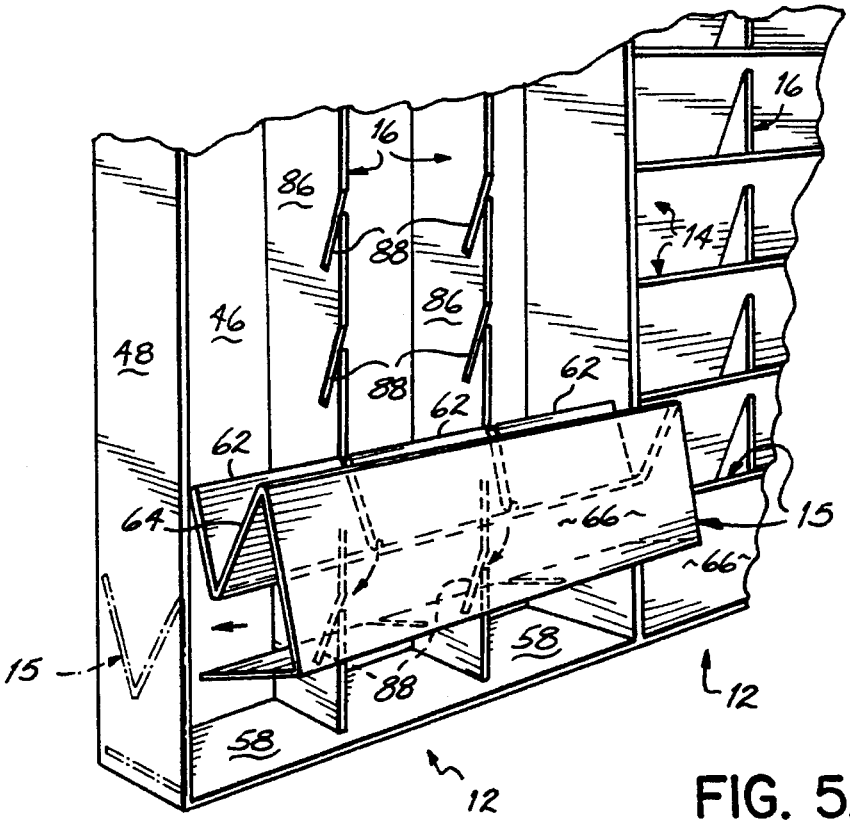
FIGS. 5A, 5B and 5C are partial perspective views showing assembly of bottom middle and top shelves onto dividers in a tray.

Referring to FIG. 5A, a lower shelf 15 is inserted into tray 12 by folding the lower shelf 15 along the fold lines separating flaps 62, panel 64, panel 66 and flaps 68. Then, flaps 62 and 68 are inserted between respective dividers 16, and panel 64 is inserted into the lower most slot 88 formed in the vertical dividers 16. As a result, panel 66 is supported above dividers 16 and generally parallel to the rear panel 46 of tray 12. At the same time, flaps 62 and 64 extend from panel 66 to rear panel 46 of tray 12, forming a shelf 15 (shown in dotted outline) suitable for carrying greeting cards or other similar flat merchandise.

Figure 5B:
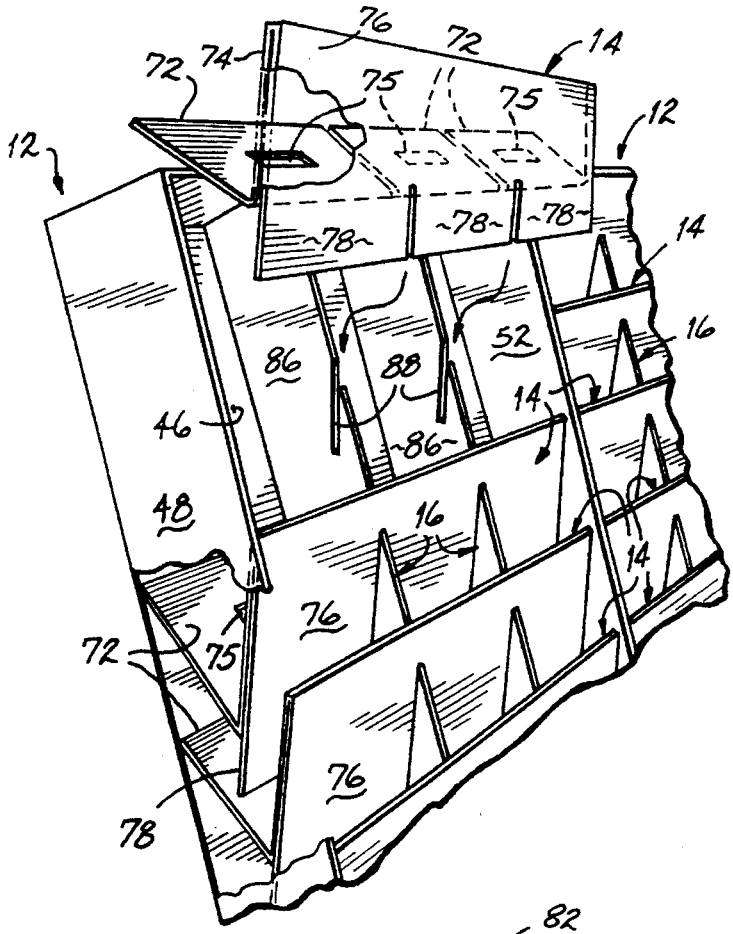

Referring to FIG. 5B, an intermediate shelf blank 14 is inserted into tray 12 by folding flaps 72, panel 74 and panel 76 along the fold lines adjoining these respective flaps and panels. Then, flap 72 and flap 78 are inserted between respective dividers 16. Next, panels 74 and 76 are inserted into slots 88 in each respective vertical divider 16. When fully inserted into slots 88, panels 74 and 76 are supported at an angle relative to rear panel 46 of tray 12, and the front fold between panels 74 and 76 is approximately flush with the front edges of the side walls 48 of tray 12. Flaps 72 extend from panel 74 rearward to the rear panel 46 of tray 12, forming a pocket or shelf 14 suitable for carrying greeting cards or other similar flat merchandise. Two such shelves 14 are illustrated in cut away.

Figure 5C:
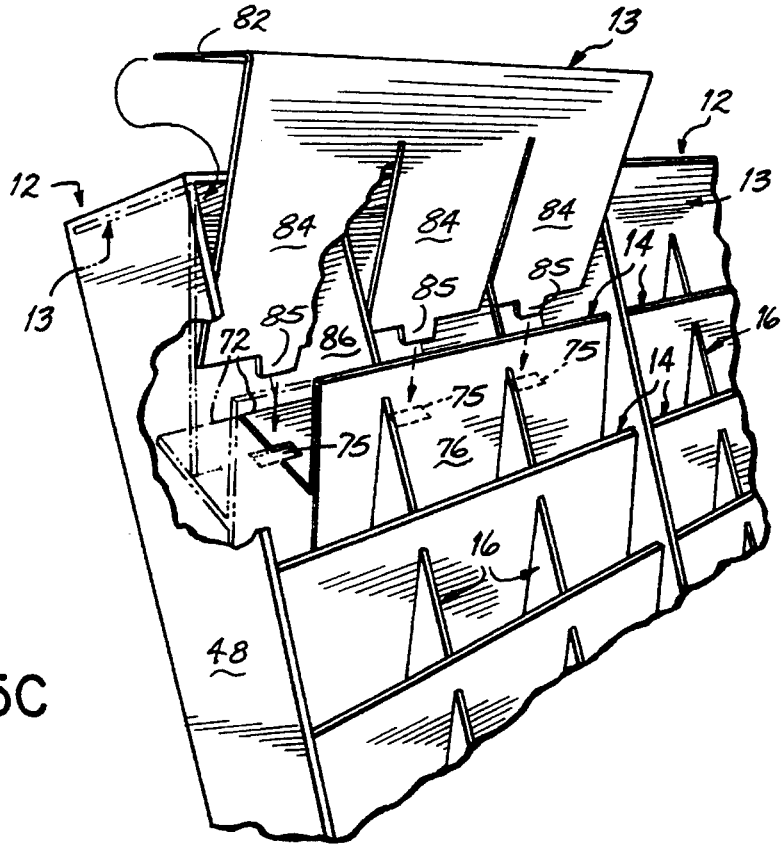

Referring to FIG. 5C, an upper shelf blank 13 is assembled into tray 12 by first folding flaps 82 at an angle to flaps 84 along the fold line therebetween. Next, flaps 82 and flaps 84 are inserted between respective dividers 16. Finally, flaps 82 and flaps 84 are pushed onto dividers 16, until the fold line between flaps 84 and flaps 82 is approximately flush with the side walls 48 of tray 12. Note that there is no slot 88 which supports the upper shelf blank, instead, as flaps 84 are pushed onto dividers 16, tabs 85 at the bottom of flaps 84 are inserted into holes 75 in the uppermost middle shelf 14, thereby retaining flaps 84 in a position to allow insertion of greeting cards between upper shelf 13 and the uppermost middle shelf 14, as shown in dotted outline.

As is apparent from FIGS. 1A and 1B, the greeting card shipment and display fixture 10 has a visually pleasing appearance generally similar to that of a permanent display fixture. Furthermore, as is apparent from FIGS. 5A–5C, the shelving in the fixture 10 is particularly suited for retaining greeting cards in an effective display position, by providing individual pockets between panels 62 and 64 (on the bottom shelf) or panels 72 and 74 (on the middle shelves) which support the greeting cards at an angle and above the rear panel 46 of tray 12. As a result, the greeting cards are positioned for easy browsing and selection by the consumer.

Thus, in accordance with principles of the present invention, there is provided a shipping and display fixture suitable for greeting cards and other similar flat merchandise, which not only holds the greeting cards during shipment, but can be readily converted from a shipping container to a visually pleasing and functional display fixture for displaying the merchandise at a retail site.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art.

For example, although the embodiment of the invention discussed above makes use of recyclable corrugated board panels cut into blanks with interlocking flaps, tabs, holes and slots, other embodiments of the inventions may use other materials such as plastic which are suitably inexpensive and may be disposed by the retailer. Furthermore, although the above discussion of the invention refers to a shipping container formed from folding panels, fixtures serving the purposes of the present invention may also be molded in a three-dimensional shape from a plastic or other suitably inexpensive and disposable and/or recyclable material.

The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A shipment and display fixture for flat merchandise, comprising a tray having a back panel and four side walls, the front edges of said side walls defining a front plane of said tray, a plurality of horizontal dividers inserted into said tray, each said divider having a front edge substantially at the front plane of said tray, and a rear edge located between said back panel and said front plane, and a plurality of compartment floor panels each extending between a respective pair of horizontal dividers and forming a floor between said pair of dividers to create a plurality of compartments above said back panel suitable for holding flat merchandise, each said floor panel comprising a rear edge in contact with and supported by said back panel, and a front edge connected to one said horizontal divider, wherein a given one of said horizontal dividers and a given one of said floor panels are formed from a blank having a first panel and a second panel joined by a fold line, said first panel forming said given one of said floor panels and connected by said fold line to said second panel, said blank further comprising a third panel joined by a second fold line to said second panel, said third panel being folded along said second fold line into doubled, face-to-face relation with said second panel, said second and third panels forming said given one of said horizontal dividers.

2. The fixture of claim 1 further comprising one vertical divider inserted into said tray, opposite ends of said vertical divider being connected to two nonadjacent side walls of said tray, said vertical divider defining divider slots cut partially through said vertical divider, the openings of said divider slots being oriented generally opposite said back panel, said horizontal dividers being received into divider slots of said vertical divider.

3. The fixture of claim 2 wherein said horizontal dividers define mating slots matable with said divider slots, said vertical divider being inserted into said mating slots.

4. The fixture of claim 1 further comprising flat merchandise in said compartments.

5. The fixture of claim 4 wherein said flat merchandise comprises greeting cards.

6. The fixture of claim 1 wherein said fixture is manufactured of corrugated board.

7. The fixture of claim 1 further comprising a crown panel attached to an end wall of said tray, said crown panel bearing decorative printing.

8. A shipment and display fixture for flat merchandise, comprising a tray having a back panel and four side walls, the front edges of said side walls defining a front plane of said tray, a plurality of horizontal dividers inserted into said tray, each said divider having a front edge substantially at the front plane of said tray, and a rear edge located between said back panel and said front plane, and a plurality of compartment floor panels each extending between a respective pair of horizontal dividers and forming a floor between said pair of dividers to create a plurality of compartments above said back panel suitable for holding flat merchandise, each said floor panel comprising a rear edge in contact with and supported by said back panel, and a front edge connected to one said horizontal divider, wherein a given one of said horizontal dividers and given one of said floor panels are formed from a blank having a first panel and a second panel joined by a fold line, said first panel forming said given one of said floor panels and connected by said fold line to said second panel, further comprising one vertical divider inserted into said tray, opposite ends of said vertical divider being connected to two nonadjacent side walls of said tray, said vertical divider defining divider slots cut partially through said vertical divider, the openings of said divider slots being oriented generally opposite said back panel, said first panel defining a first panel slot along its entire width, said first panel slot being inserted over said vertical divider, said second panel being received into a divider slot of said vertical divider.

9. The fixture of claim 8 wherein said second panel defines a second panel slot partially across its width, said vertical divider being received in said second panel slot.

10. The fixture of claim 9 wherein said blank further comprises a third panel joined by a second fold line to said second panel, said third panel being folded along said second fold line into doubled, face-to-face relation with said second panel, said second and third panels forming said given one of said horizontal dividers, said third panel defining a third panel slot partially across its width, said vertical divider being received in said third panel slot.

11. The fixture of claim 8 wherein said fixture is manufactured of corrugated board.

12. The fixture of claim 8 further comprising a crown panel attached to an end wall of said tray, said crown panel bearing decorative printing.

13. The fixture of claim 8 further comprising flat merchandise in said compartments.

14. The fixture of claim 13 wherein said flat merchandise comprises greeting cards.

15. A shipment and display fixture for flat merchandise, comprising a tray having a back panel and four side walls, the front edges of said side walls defining a front plane of said tray, a plurality of horizontal dividers inserted into said tray, each said divider having a front edge substantially at the front plane of said tray, and a rear edge located between said back panel and said front plane, and a plurality of compartment floor panels each extending between a respective pair of horizontal dividers and forming a floor between said pair of dividers to create a plurality of compartments above said back panel suitable for holding flat merchandise, wherein one of said floor panels in said tray includes a hole, and one of said horizontal dividers comprises, on its rear edge, a tab lockably engaged into said hole.

16. The fixture of claim 15 wherein an uppermost one of said horizontal dividers comprises said tab.

17. The fixture of claim 16 wherein said uppermost one of said horizontal dividers further comprises a back panel extending between the front edge of said uppermost one of said horizontal dividers and said back panel, locating said front edge of said uppermost one of said horizontal dividers with respect to said front plane of said tray.

18. The fixture of claim 17 further comprising one vertical divider inserted into said tray, opposite ends of said vertical divider being connected to two nonadjacent side walls of said tray, said uppermost one of said horizontal dividers defining a slot for receiving said vertical divider.

19. The fixture of claim 15 wherein said fixture is manufactured of corrugated board.

20. The fixture of claim 15 further comprising a crown panel attached to an end wall of said tray, said crown panel bearing decorative printing.

21. The fixture of claim 15 further comprising flat merchandise in said compartments.

22. The fixture of claim 21 wherein said flat merchandise comprises greeting cards.

23. A shipment and display fixture for flat merchandise, comprising a tray having a back panel and four side walls, the front edges of said side walls defining a front plane of said tray, a plurality of horizontal dividers inserted into said tray, each said divider having a front edge substantially at the front plane of said tray, and a rear edge located between said back panel and said front plane, and a plurality of compartment floor panels each extending between a respective pair of horizontal dividers and forming a floor between said pair of dividers to create a plurality of compartments above said back panel suitable for holding flat merchandise, each said floor panel comprising a rear edge in contact with and supported by said back panel, and a front edge connected to one said horizontal divider, wherein a lowermost one of said horizontal dividers and a lowermost one of said floor panels are formed from a blank having a first panel and a second panel joined by a fold line, said first panel forming said lowermost one of said floor panels and connected by said fold line to said second panel, said blank further comprising a third panel joined by a second fold line to said second panel, and a fourth panel joined by a third fold line to said third panel, said third panel being folded along said second fold line into an orientation generally parallel to said front plane, said fourth panel extending between said third panel and said back panel, locating said third panel in an orientation generally parallel to said front plane.

24. The fixture of claim 23 further comprising one vertical divider inserted into said tray, opposite ends of said vertical divider being connected to two nonadjacent side walls of said tray, said vertical divider defining divider slots cut partially through said vertical divider, the openings of said divider slots being oriented generally opposite said back panel, said first and fourth panels defining first and fourth panel slots along their entire width, said first and fourth panel slots being inserted over said vertical divider, said second panel defining a second panel slot along a portion of its width adjacent said first panel, said second panel being received into one of said divider slots of said vertical divider.

25. The fixture of claim 23 wherein said fixture is manufactured of corrugated board.

26. The fixture of claim 23 further comprising a crown panel attached to an end wall of said tray, said crown panel bearing decorative printing.

27. The fixture of claim 23 further comprising flat merchandise in said compartments.

28. The fixture of claim 27 wherein said flat merchandise comprises greeting cards.

29. A shipment and display fixture for flat merchandise, comprising first and second trays each having a back panel and four side walls, the front edges of the side walls of a respective tray defining a front plane of the respective tray, first and second pluralities of horizontal dividers inserted respectively into said first and second trays, each said divider having a front edge substantially at the front plane of the tray in which said divider is inserted, and a rear edge located between the back panel and front plane of the tray in which said divider is inserted, and a plurality of compartment floor panels each extending between a respective pair of horizontal divider panels and forming a floor between said pair of divider panels to create a plurality of compartments above said back panels suitable for holding said flat merchandise, end walls of said trays being attached together forming a hinge between said trays, said trays being foldable together along said hinge to form a box protecting flat merchandise during shipment.

30. The fixture of claim 29 wherein said fixture is manufactured of corrugated board.

31. The fixture of claim 29 further comprising a crown panel attached to end walls of said trays, said crown panel bearing decorative printing.

32. The fixture of claim 29 further comprising flat merchandise in said compartments.

33. The fixture of claim 32 wherein said flat merchandise comprises greeting cards.

* * * * *